US008549746B2

(12) United States Patent
Wehling et al.

(10) Patent No.: US 8,549,746 B2
(45) Date of Patent: Oct. 8, 2013

(54) PROCESS FOR THE SURFACE TREATMENT OF ALUMINIUM

(75) Inventors: Hans-Wilhelm Wehling, Heilbronn (DE); Stefan Robert Muller, Bopfingen-Kerkingen (DE); Dietmar Gruedl, Asperg (DE)

(73) Assignee: VALEO Schalter und Sensoren GmbH, Bietigheim-Bissingen (DE)

( * ) Notice: Subject to any disclaimer, the term of this patent is extended or adjusted under 35 U.S.C. 154(b) by 0 days.

(21) Appl. No.: 12/677,897

(22) PCT Filed: Jul. 9, 2008

(86) PCT No.: PCT/EP2008/005574

§ 371 (c)(1), (2), (4) Date: Mar. 12, 2010

(87) PCT Pub. No.: WO2009/036826

PCT Pub. Date: Mar. 26, 2009

(65) Prior Publication Data

US 2010/0213793 A1 Aug. 26, 2010

(30) Foreign Application Priority Data

Sep. 12, 2007 (DE) ..... 10 2007 043 479

(51) Int. Cl.
*H01R 43/16* (2006.01)

(52) U.S. Cl.
USPC ..... 29/874; 29/825; 29/879; 29/884

(58) Field of Classification Search
USPC ..... 29/825, 874, 879, 884
See application file for complete search history.

(56) References Cited

U.S. PATENT DOCUMENTS

| | | | | | |
|---|---|---|---|---|---|
| 3,140,172 | A | * | 7/1964 | Coad | 419/9 |
| 3,468,774 | A | * | 9/1969 | Kendall | 205/723 |
| 3,562,013 | A | * | 2/1971 | Mickelson et al. | 134/3 |
| 4,093,453 | A | * | 6/1978 | Makino et al. | 148/527 |
| 4,126,523 | A | * | 11/1978 | Wong | 205/212 |
| 4,525,250 | A | * | 6/1985 | Fahrmbacher-Lutz et al. | 205/212 |
| 5,098,485 | A | * | 3/1992 | Evans | 148/272 |
| 5,464,524 | A | * | 11/1995 | Ogiwara et al. | 205/170 |
| 6,096,391 | A | * | 8/2000 | Muffoletto et al. | 427/580 |
| 6,740,420 | B2 | * | 5/2004 | Muffoletto et al. | 428/469 |
| 6,932,897 | B2 | * | 8/2005 | Burca et al. | 205/212 |
| 7,611,588 | B2 | * | 11/2009 | Peitersen et al. | 134/26 |
| 7,687,449 | B2 | * | 3/2010 | Powers et al. | 510/185 |
| 2005/0276989 | A1 | | 12/2005 | Dees | |

FOREIGN PATENT DOCUMENTS

| | | | |
|---|---|---|---|
| DE | 43 17 217 | A1 | 12/1994 |
| DE | 102 37 721 | A1 | 2/2004 |
| EP | 0 930 607 | A2 | 7/1999 |
| JP | 2007-060340 | A | 3/2007 |
| WO | WO 2006/131716 | A1 * | 12/2006 |

OTHER PUBLICATIONS

International Search Report w/translation from PCT/EP2008/005574 dated Nov. 14, 2008.

* cited by examiner

*Primary Examiner* — Carl Arbes
(74) *Attorney, Agent, or Firm* — Osha Liang LLP

(57) ABSTRACT

The invention proposes a process for the surface treatment of aluminum in order to produce an electrical contact, and a corresponding component part, wherein an oxide layer on the aluminum surface is removed, for example by etching, in a first step and, in a second step, before an oxide layer is re-formed, the surface is sealed wet-chemically with a conversion layer having metal ions of zirconium or titanium.

6 Claims, 3 Drawing Sheets

PROCESS FOR THE SURFACE TREATMENT OF ALUMINIUM

PRIOR ART

The invention relates to a process for the surface treatment of aluminium and to a layer structure of an aluminium component part, for example for making contact with an ultrasonic transducer, according to the generic features of independent Claims 1, 6 and 10.

By way of example, component parts such as these are constructed with diaphragms for ultrasonic transducers with milled or deep-drawn aluminium geometries, in which an electrical contact, in particular an earth contact, has to be produced between the aluminium geometries and the electrical components, such as ultrasonic transducers, for example in order to reduce the EMC sensitivity. In automotive engineering, use is made of ultrasound-based surrounding-area recording systems which are known, for example, from DE 102 37 721 A1 and have at least one ultrasonic sensor, wherein each ultrasonic sensor emits an ultrasonic signal which is reflected by a possible obstacle and can be received by the same ultrasonic sensor and/or by further ultrasonic sensors.

In this case, the ultrasonic signal is produced by means of a piezoceramic which is adhesively bonded to the inner side of the aluminium geometry as electrical component. Here, the piezoceramic is generally adhesively bonded to the non-conductive aluminium oxide layer of the aluminium geometry by means of a non-conductive adhesive, in which case an oxide layer always re-forms within a short time on the surface of the aluminium after a surface cleaning process, for example etching or machining.

There are special solders for the required production of electrical connections on aluminium, but these have to be soldered with a large amount of etching flux, and this in turn has to be removed by washing. However, it is difficult to carry out the cleaning and drying which are then required on an automated assembly line. In addition, the solder point on the vibration-sensitive diaphragm base of the ultrasonic transducer, on which only small amounts of solder are permissible, represents a critical variable in order to avoid impairing the operation of the ultrasonic transducer. The aluminium solder is only in the form of a filler wire and would possibly produce an excessive amount of solder and therefore an excessive inert mass.

The existing customary processes for the earth connection of such components have a series of disadvantages. These result, for example, from large amounts of solder or else high temperatures during the soldering of a braid with aluminium solder on the diaphragm or during resistance welding, or from mechanical impairments during the swaging of a braid on the diaphragm, during the pressing of a pin into the diaphragm or during the bonding of a braid on the diaphragm.

SUMMARY OF THE INVENTION

The invention is based on a process for the surface treatment of aluminium in order to produce an electrical contact, wherein, according to the invention, an oxide layer on the aluminium surface is advantageously removed in a first step and, in a second step, before an oxide layer is re-formed, the surface is sealed with a conversion layer having incorporated metal ions. The oxide layer can be removed simply by etching and the surface can be sealed wet-chemically with metal ions of zirconium or titanium.

In addition to the surface preparation processes which are currently customary for degreasing, etching or pickling, for example in order to prepare the lacquering of the aluminium surface, according to the invention the metal ions, such as titanium or zirconium, dissolved in liquid are used to enrich a conductive metal layer on the cleaned aluminium which, at the same time, also reacts poorly with oxygen and prevents the renewed formation of an oxide layer.

Contact can then be made with electrical components in a manner known per se on the sealed and conductive surface by means of a conductive adhesive. On the other hand, however, a lacquer or a comparable insulation medium or anti-corrosion medium can also be applied to the sealed surface in a further coating step.

In the case of an aluminium component part according to the invention, the layer structure produced by the process described above on the surface of the aluminium can therefore be used in a simple manner to make electrical contact with a component.

By way of example, the component may be a piezoceramic component of which the earth contact then makes electrical contact with the surface of the aluminium component part. According to one particularly advantageous embodiment, the component part preferably has a hollow-cylindrical, for example milled or deep-drawn inner geometry with a diaphragm as the termination, to the inside of which an ultrasonic transducer can be applied as an electrical component in a mechanically fixed manner to produce an electrical earth contact with the diaphragm. By way of example, such a component part may be a constituent part of an ultrasonic sensor for a surrounding-area recording system, mentioned in the introduction of the description, in a parking assistance system of a motor vehicle.

According to the invention, the production of an electrically conductive coating with simultaneous removal of the oxide layer on aluminium is therefore inexpensive and easy to reproduce. The surface produced in this way enables permanent adhesion with an adhesive, conductive adhesive or simple soldering. No additional production steps are required in the final assembly, it being possible to apply the coating according to the invention to the inside and outside, for example, of the diaphragm: on the inside as an electrically conductive surface and as corrosion protection and as a surface for mechanically fixed adhesive bonding, and on the outside as corrosion protection and as a substrate for lacquering.

BRIEF DESCRIPTION OF THE DRAWING

Exemplary embodiments of the invention are explained with reference to the figures in the drawing, in which.

WAYS OF IMPLEMENTING THE INVENTION

Figure 1:
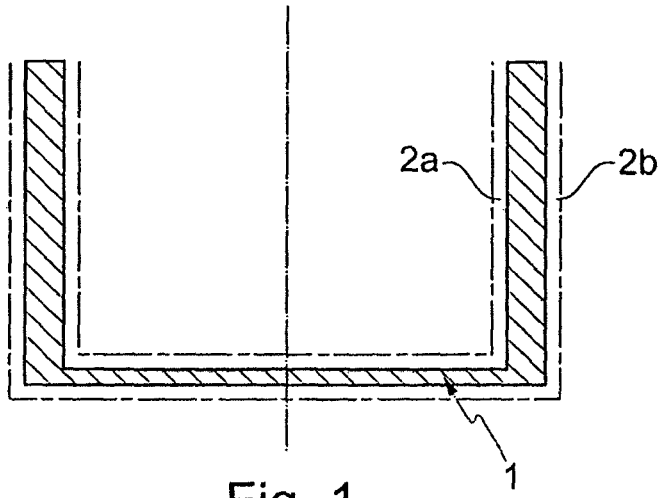
FIG. 1 shows a section through an aluminium component part for forming a diaphragm for an ultrasonic transducer which has been treated using the process according to the invention.

FIG. 1 shows a section through an aluminium component part for forming a diaphragm 1 for an ultrasonic transducer which is provided with a conversion layer 2 which has the inner surface 2*a* and the outer surface 2*b*, produces conductivity on the inside and simultaneously provides corrosion protection, improves the adhesive properties, prevents reformation of oxidation layers and, on the outside, forms corrosion protection with better adhesion for a layer of lacquer.

In this case, the conversion layer 2, or 2*a*, 2*b*, is formed by removing an oxide layer on the aluminium surface of the diaphragm 1 in a first step and, in a second step, before an oxide layer is re-formed, by sealing the surface of the diaphragm 1 with the conversion layer 2, or 2*a*, 2*b*, having incorporated metal ions of zirconium or titanium. The oxide layer can be removed in the first step simply by etching and the surface can be sealed wet-chemically with the metal ions.

Figure 2:
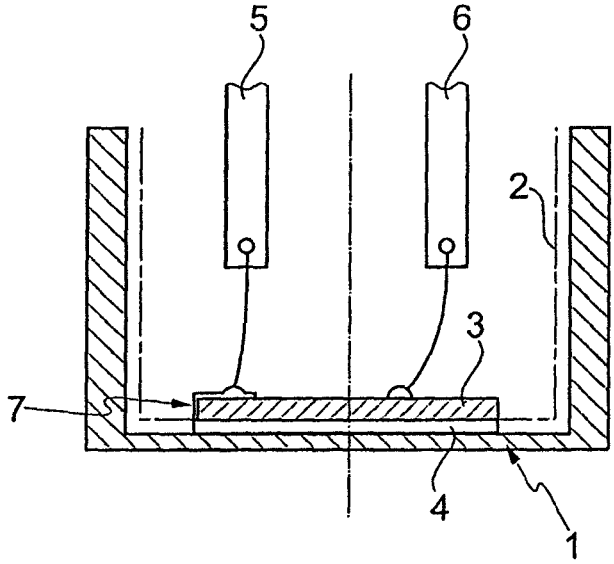
FIG. 2 shows a section through a component part as shown in FIG. 1 having a piezoceramic component with which electrical contact is made, in this case an ultrasonic transducer.

FIG. 2 shows how a piezoceramic component in the form of an ultrasonic transducer 3 is electrically conductively joined to the diaphragm 1 inside the diaphragm 1 by means of a conductive adhesive 4 in the form of an earth contact. Contact is then made with the ultrasonic transducer 3 on the outside with a contact 5 for the earth connection and a contact 6 for the other potential. The earth connection is made here via a conductive surface 7 which is drawn around over the ultrasonic transducer 3, for example with the conductive adhesive 4.

Figure 3:
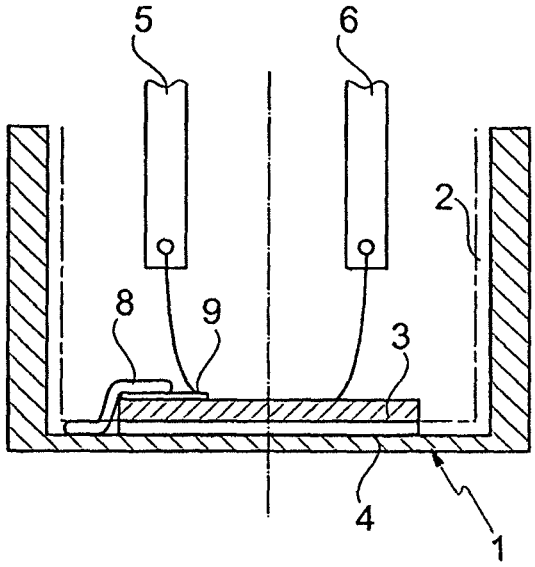
FIG. 3 shows a section through a component part as shown in FIG. 1 having a piezoceramic ultrasonic transducer with which electrical contact is made via a bead of conductive adhesive.
Figure 4:
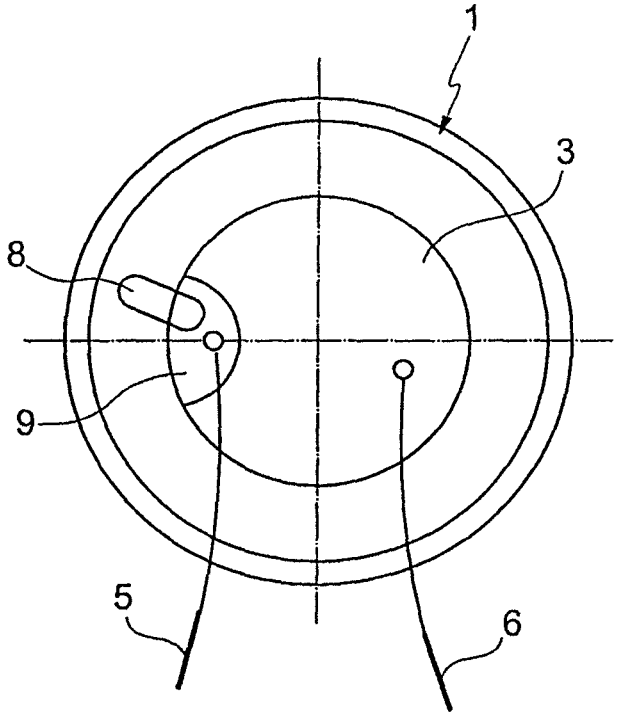
FIG. 4 shows a cross section through the component part shown in FIG. 3.

FIG. 3 shows an alternative to the earth connection of the ultrasonic transducer 3 to the diaphragm 1 via a bead 8 of conductive adhesive which is routed at the side from the conductive surface of the diaphragm 1 to the earth contact 5 via a conductive earth surface 9 on the ultrasonic transducer 3. In this respect, FIG. 4 shows a cross section which is provided with the same reference symbols.

Figure 5:
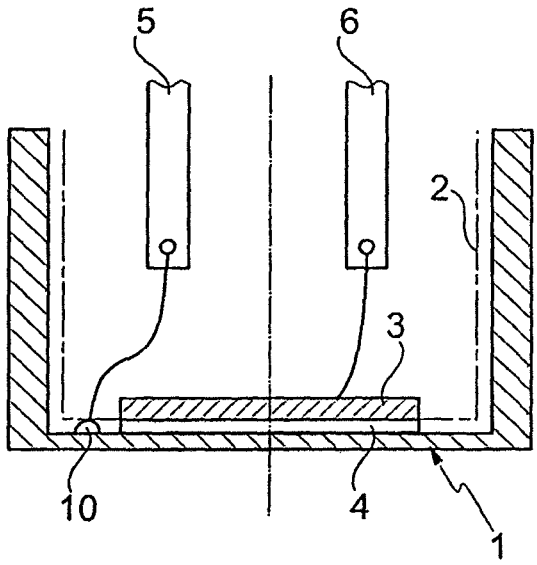
FIG. 5 shows a section through a component part as shown in FIG. 1 having a piezoceramic ultrasonic transducer with which electrical contact is made via a connection on the inner diaphragm surface.

FIG. 5 also shows an alternative electrical connection of the ultrasonic transducer 3 which makes electrical contact with the diaphragm 1, in which a soldering terminal 10 is arranged on the inner surface of the diaphragm 1, which inner surface is connected to the earth potential of the ultrasonic transducer 3 which makes electrical contact with the inner surface of the diaphragm 1 via the conductive adhesive 4, and via which contact can then be made with the contact 5.

The invention claimed is:

1. A method for a surface treatment of aluminium in order to produce an electrical contact between an aluminium component part and a piezoceramic component, comprising:

removing an oxide layer on the aluminium surface;

before an oxide layer is re-formed, sealing the surface with a conversion layer having incorporated metal ions; and electrically connecting an earth contact of the piezoceramic component to the surface of the aluminium component part.

2. The method according to claim 1, wherein the oxide layer is removed by etching.

3. The method according to claim 1, wherein the surface is sealed wet-chemically with metal ions of zirconium or titanium.

4. The method according to claim 1, wherein the electrical contact is made with electrical components on the sealed surface by means of a conductive adhesive.

5. The method according to claim 1, further comprising coating the sealed surface with one of a lacquer, a comparable insulation medium, and an anti-corrosion medium.

6. The method according to claim 1, wherein the earth contact of the piezoceramic component and the surface of the aluminium component part are electrically connected by a conductive adhesive.

* * * * *